US006089150A

United States Patent [19]

Uchiyama

[11] Patent Number: 6,089,150

[45] Date of Patent: Jul. 18, 2000

[54] STENCIL PRINTING MACHINE WITH CONVEYING MEANS HAVING SUCTION

[75] Inventor: Koichi Uchiyama, Ibaraki-ken, Japan

[73] Assignee: Riso Kagaku Corporation, Tokyo, Japan

[21] Appl. No.: 09/159,667

[22] Filed: Sep. 24, 1998

[30] Foreign Application Priority Data

Oct. 6, 1997 [JP] Japan ..... 9-272658

[51] Int. Cl.[7] ..... B05C 17/04; B41L 13/04

[52] U.S. Cl. ..... 101/126; 101/116

[58] Field of Search ..... 101/116, 119, 101/120, 123, 124, 126

[56] References Cited

U.S. PATENT DOCUMENTS

| | | | |
|---|---|---|---|
| 2,419,695 | 4/1947 | Shuttleworth et al. | 101/119 |
| 3,033,702 | 5/1962 | Fenselau | 101/116 |
| 3,221,649 | 12/1965 | Weiss | 101/129 |
| 3,844,212 | 10/1974 | Vosburg et al. | 101/116 |
| 4,173,928 | 11/1979 | Mitter | 101/126 |
| 4,612,874 | 9/1986 | Mitter | 101/119 |
| 5,713,275 | 2/1998 | Imai | 101/119 |

FOREIGN PATENT DOCUMENTS

| | | |
|---|---|---|
| 0 742 106 | 11/1996 | European Pat. Off. . |
| 0 749 844 | 12/1996 | European Pat. Off. . |

OTHER PUBLICATIONS

Patent Abstracts of Japan, vol. 095, No. 001, Feb. 28, 1995 & JP 06 286286 A (Riso Kagaku Corp.), Oct. 11, 1994.

*Primary Examiner*—John S. Hilten
*Assistant Examiner*—Leslie J. Grohusky
*Attorney, Agent, or Firm*—Kaensaka & Takeuchi

[57] ABSTRACT

In a stencil printing machine, one surface of a stencil sheet with a perforated image is placed in contact with an upper surface of a printing material. Ink is provided on the other surface of the stencil sheet. Suction force is exerted on a bottom surface of the printing material, so that the ink is allowed to pass through the perforated image and then transfer to the upper surface of the printing material, thereby completing stencil printing.

4 Claims, 5 Drawing Sheets

STENCIL PRINTING MACHINE WITH CONVEYING MEANS HAVING SUCTION

BACKGROUND OF THE INVENTION

The present invention relates to a stencil printing machine for conducting printing on a printing material by using a stencil sheet.

In a stencil printing method, ink such as emulsion ink is provided to one surface of a stencil sheet with a perforated image formed therein, a printing sheet is placed on the other surface of the stencil sheet, and then the ink is pressed to transfer through the perforated image onto the printing sheet.

As a method for exerting pressure on the ink to transfer, there has been mentioned a flat press method and a squeegee method. In the flat method, whole area of the stencil sheet is uniformly pressed at one operation. In the squeegee method, pressure is exerted in a linear form on the stencil sheet while shifting by moving a squeegee plate or a squeegee roller along the stencil sheet.

In both of the methods described above, the pressurized ink portions press other ink portions below. That is, the ink itself functions as a pressure transmitting substance for extruding the ink. As to the ink used in the methods described above, as the fluidity or softness of ink is increased, it permeates faster into the printing sheet. This decreases a drawback caused by set-off, i.e. ink stain on the back surfaces of the printed sheets stacked. In this situation, however, capillarity phenomenon arises between the stencil sheet and the printing sheet, thereby causing an excessive-ink flow and ink bleeding to deteriorate quality of the printed images.

Conversely, ink with low fluidity and softness, i.e. hard ink, does not cause capillarity phenomenon easily, thereby improving quality of the printed images. In this situation, however, there arise other problems such that it takes a long time to permit ink to permeate into the printing sheet after ink-transfer on the printing sheet, and that set-off occurs since excess ink is transferred to the printing sheet because of high viscosity thereof.

Further, in the flat press method, although there is an advantage such that it uses a simple mechanism, more solid ink is used owing to a fear of ink-leakage which worsens the drawback of set-off.

On the other hand, the squeegee method is complex and large-scale since it requires high squeegee pressure.

Accordingly, an object of the present invention is to provide a stencil printing method and a stencil printing machine which overcome the contradictory phenomena previously explained, and can provide stencil printing with an excellent printing quality and less set-off.

SUMMARY OF THE INVENTION

A stencil printing method as defined in the first aspect of the present invention comprises placing one surface of a stencil sheet with a perforated image on an upper surface of a printing material to contact therewith, providing ink on the other surface of the stencil sheet, and exerting suction force on a bottom surface of the printing material, thereby allowing the ink to pass through the perforated image and then transfer to the upper surface of the printing material.

According to a stencil printing method as defined in the second aspect of the present invention, in the stencil printing method of the first aspect, the suction force is exerted on a portion of the bottom surface of the printing material so as to allow the ink to transfer onto a portion of the upper surface corresponding to the portion of the bottom surface while the portion of the bottom surface moves relative to the printing material, thereby forming an image on the upper surface of the printing material according to the perforated image.

According to a stencil printing method as defined in the third aspect of the present invention, in the stencil printing method of the second aspect, the ink is pre-provided on the other surface of the stencil sheet.

According to a stencil printing method as defined in the fourth aspect of the present invention, in the stencil printing method of the second aspect, before the suction force is exerted on the portion of the bottom surface, the ink is provided on a portion of the other surface of the stencil sheet corresponding to the portion of the bottom surface of the printing material.

A stencil printing machine as defined in the fifth aspect of the present invention comprises a stencil sheet with a perforated image formed therein, the stencil sheet having one surface adapted to contact an upper surface of a printing material and the other surface to be provided with ink; suction means for exerting suction force on a bottom surface of the printing material while contacting the bottom surface at a position beneath the printing material, thereby allowing the ink to pass through the perforated image and then transfer to the upper surface of the printing material; means for changing the position of the suction means by moving the suction means.

According to the sixth aspect of the present invention, in the stencil printing machine of the fifth aspect, the stencil printing machine further comprises a drum rotationally driven around a central axis thereof, the drum having an ink-permeable cylindrical peripheral wall with the stencil sheet wrapped around an outer peripheral surface thereof and ink supply means situated in the peripheral wall; and conveying means for conveying the printing material while sandwiching the printing material between the drum and the conveying means, and further the suction means is formed in the conveying means.

According to a stencil printing machine as defined in the seventh aspect of the present invention, in the stencil printing machine of the sixth aspect, the ink supply means has a space formed along the peripheral wall and filled with the ink, the conveying means has an air permeable conveying belt situated adjacent to the drum and driven to rotate, and the suction means has a suction duct situated on the opposite side of the drum relative to the conveying belt for sucking the printing material through the conveying belt.

According to a stencil printing machine as defined in the eighth aspect of the present invention, in the stencil printing machine of the sixth aspect, the ink supply means has a squeegee for applying the ink to an inner peripheral surface of the drum, the conveying means has a roller situated adjacent to the drum and driven to rotate, and the sucking means has a cylindrical enclosure disposed on an outer peripheral surface of the roller and a suction pump for sucking air inside of the enclosure.

According to a stencil printing machine as defined in the ninth aspect of the present invention, in the stencil printing machine of the fifth aspect, the stencil printing machine further comprises a frame with a predetermined thickness and an ink impermeable sheet disposed on one surface of said frame; further the stencil sheet is disposed on the other surface of the frame; an inside of the frame is filled with the ink; the suction means has a suction nozzle adapted to contact the bottom surface of the printing material; and the means for changing the position moves the suction nozzle relative to the printing material.

According to a stencil printing machine as defined in the tenth aspect of the present invention, in the stencil printing machine of the ninth aspect, the printing material is a sheet, and the suction nozzle has an opening covering a length corresponding to a width of the sheet along a direction perpendicular to a moving direction of the suction nozzle.

According to a stencil printing machine as defined in the eleventh aspect of the present invention, in the stencil printing machine of the ninth aspect, the printing material is a rolled sheet; the suction nozzle has an opening covering a length corresponding to a width of the sheet along a direction perpendicular to a moving direction of the suction nozzle; and the stencil printing machine further comprises a providing unit for unrolling the rolled sheet and a rolling unit for rolling the rolled sheet after printing.

According to a stencil printing machine as defined in the twelfth aspect of the present invention, in the stencil printing machine of the fifth aspect, the stencil sheet is in a form of a continuous strip, and the stencil printing machine further comprises a providing unit for providing the stencil sheet for use and a rolling unit for rolling the stencil sheet after the use.

According to a stencil printing machine as defined in the thirteenth aspect of the present invention, in the stencil printing machine of the twelfth aspect, the stencil sheet is movable along a main scanning direction; the printing material is movable along a sub-scanning direction perpendicular to the main scanning direction; the suction means is disposed beneath the printing material in a position corresponding to the stencil sheet while being movable along the main scanning direction; and the stencil printing machine further comprises perforating means disposed over the stencil sheet to be movable along the main scanning direction for perforating the stencil sheet and ink supply means disposed over the stencil sheet to be movable along the main scanning direction for supplying the ink to the stencil sheet.

According to a stencil printing machine as defined in the fourteenth aspect of the present invention, in the stencil printing machine of the twelfth aspect, the stencil sheet and the printing material are movable along a sub-scanning direction; the suction means is disposed along a main scanning direction perpendicular to the sub-scanning direction; and the stencil printing machine further comprises a conveying roller for conveying the stencil sheet and the printing material along the sub-scanning direction while holding the stencil sheet and the printing material in contact with each other, perforating means disposed along the main scanning direction in a position before the suction means relative to moving direction of the stencil sheet and perforating the stencil sheet, and ink supply means disposed along the main scanning direction in a position corresponding to the suction means and supplying the ink to the stencil sheet.

A stencil sheet has a large amount of ink on one surface thereof. The other surface of the stencil sheet is placed in contact with one surface of a printing material having air-permeability. When suction means sucks the printing material from the other surface, the ink is forced to transfer through a perforated image of the stencil sheet onto the printing material and then adhere thereto under an atmospheric pressure.

Then, since the ink on the stencil sheet is pressed only in a direction of suction by the atmospheric pressure, the ink on the stencil sheet may not spread to leak. Further, microscopic observation shows that the ink is pressed only in the thickness direction of the printing material when it is transferred to the printing material from the stencil sheet. Hence, ink bleeding by diffusion in the printing material is reduced, and a clear printed image is obtained. Additionally, sucking helps the ink to permeate to the inside of the printing material, thereby reducing the set-off.

Further, in a method where a small adequate amount of ink is thinly pre-applied on the stencil sheet and the suction is conducted at the next step, image quality is assured and the setoff is reduced. This is because only the ink applied to the stencil sheet is transferred to the printing material and excessive ink is not transferred thereto.

DETAILED DESCRIPTION OF PREFERRED EMBODIMENTS

Figure 1:
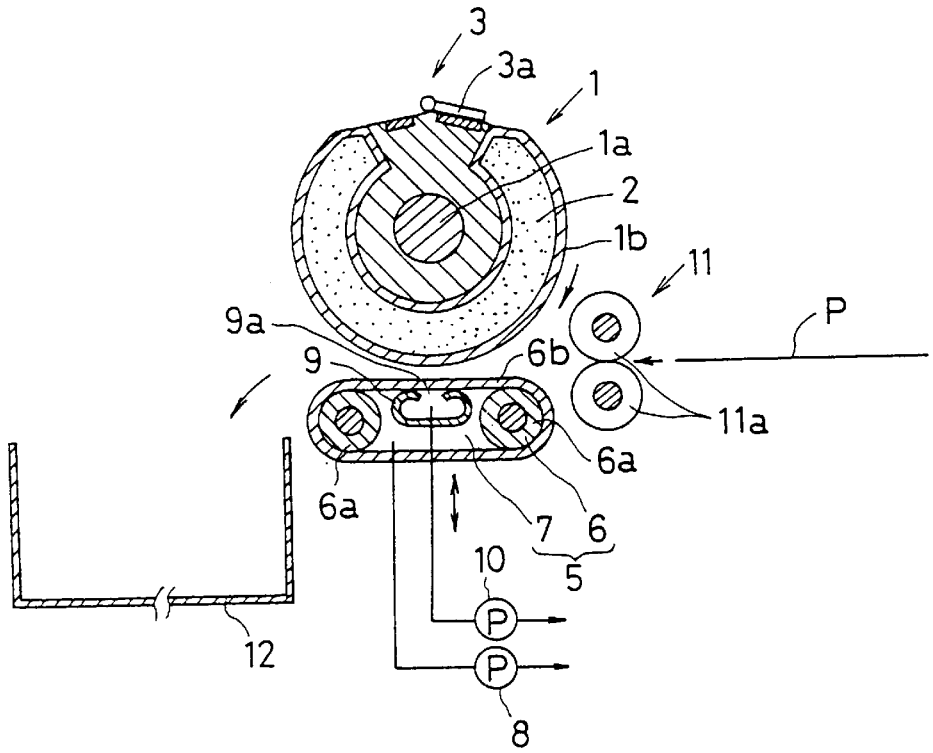
FIG. 1 is a sectional view of a stencil printing plate in a first embodiment of the present invention.

FIG. 1 is a sectional view of a stencil printing machine in a first embodiment of the present invention.

A rotary drum 1 is cylindrical and driven to rotate around a center axis 1*a* in a direction indicated by an arrow in the drawing. In an outer peripheral surface 1*b* of the rotary drum 1, numerous fine holes are formed. Along the outer peripheral surface 1*b*, a portion of a space inside the drum 1 is partitioned, and the portion is filled with ink 2 for printing.

A stencil sheet with a perforated image formed therein is wound around the outer peripheral surface 1*b* of the rotary drum 1. A leading end of the stencil sheet is held by a clamp plate 3*a* of clamping means 3. The rotary drum 1 is so constituted that the drum can store the ink 2 inside. The drum 1 is detachable from the machine independently of the other parts of the machine. The drum is detached from the machine when the color of the ink 2 is changed or the ink 2 is supplied.

Suction-conveying means 5 for a printing material (printing sheet) P is disposed at a position facing the rotary drum 1. The suction-conveying means 5 comprises conveying means 6 and suction means 7.

The conveying means 6 includes a pair of conveying rollers 6*a*, 6*a* and a conveying belt 6*b* connecting said rollers. The conveying belt 6*b* is formed to be porous. The suction means 7 is disposed on a bottom surface of the conveying belt 6*b*.

The suction means 7 comprises conveying-suction section for conveying the printing sheet P and printing-suction section for sucking the ink to be transferred onto the printing sheet P.

The conveying-suction section sucks the whole area of the conveying belt 6*b* (an upper portion for conveying) by a suction pump 8. Suction by the pump is relatively weak, and the printing sheet P can be conveyed by the belt while being held on the belt by the suction.

Printing-suction section comprises a suction duct 9 that has an opening 9*a* at a position facing the rotary drum 1. The suction duct sucks a part of the conveying belt 6*b* through the opening. According to the printing-suction section, the ink 2 in the rotary drum 1 is sucked through the printing sheet P and the stencil sheet by relatively high suction force of a suction pump 10. The opening 9*a* is formed in a longitudinal shape, which corresponds to the axial-length of the rotary drum 1, along a direction perpendicular to the sheet-surface of the drawing.

The suction pumps 8, 10 are of piston-type, and can be manually operated to drive the rotary drum 1. Additionally, as a suction pump 8 or 10, a Bimorph pump or a fan motor may be adapted.

The suction-conveying means 5 is movable upwardly and downwardly beneath the rotary drum 1 by a non-illustrated drive unit. The suction-conveying means 5 presses the printing sheet P against the rotary drum 1 by moving upward in synchronization with conveyance of the printing sheet P, and avoid a collision with the clamping means 3 by moving downwards after the conveyance.

Sheet supply means 11 transfers the printing sheet P from a sheet supply table to the rotary drum 1 by using a pair of supply rollers 11*a*.

On a discharge tray 12, the printing sheet P as printed is stacked after being conveyed by the suction-conveying means 5.

Figure 2:
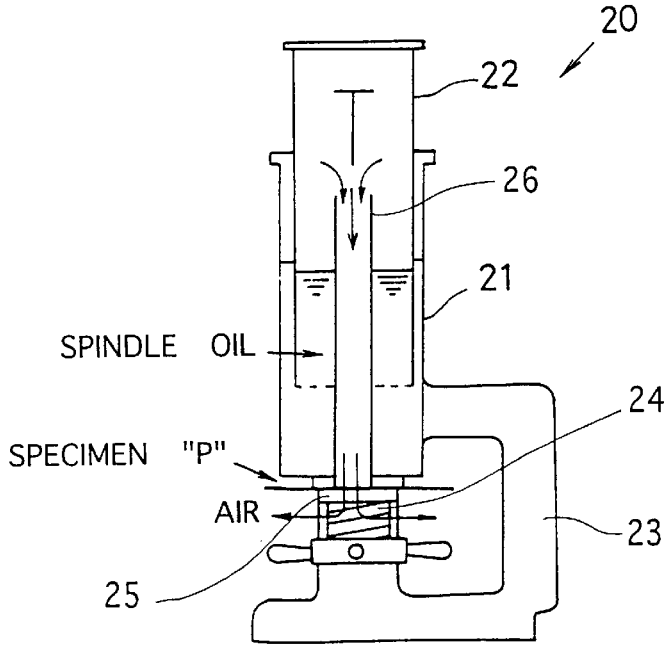
FIG. 2 is a view of a testing machine for measuring air-permeability of a printing sheet.

The printing sheet P is composed of porous material such as paper and has a given air-permeability. The air-permeability can be measured by the Gurley densometer, which is shown in FIG. 2 and specified by JIS P 8117-1980.

The Gurley densometer 20 measures time required for a certain amount of air to permeate through a given area of a specimen. The densometer includes a base 23. A holding mechanism 24 is fixed to a lower portion of the base 23. The holding mechanism 24 can move vertically by a screw. On the top of the holding mechanism, a gasket 25 is disposed. An outer cylinder 21 is vertically fixed to an upper portion of the base 23. The outer cylinder 21 is of a concentric dual-cylinder structure. That is, a vent cylinder 26 is concentrically placed inside the outer cylinder 21. The top of the outer cylinder 21 is opened, and the bottom is closed. The top of the vent cylinder 26 is opened, and the bottom is also opened after penetrating the bottom of the outer cylinder. Spindle oil fills a space between the outer cylinder 21 and the vent cylinder 26. An inner cylinder 22 has a closed top and an opened bottom. The inner cylinder 22 is inserted into the outer cylinder 21 from the top of the outer cylinder 21.

Testing for air permeability of printing sheet will be performed following the next steps. Firstly, a printing sheet P as a specimen is placed on the gasket 25, and then pressed against the bottom of the vent cylinder 26 to be in close contact with the opening of the bottom by the holding mechanism 24. Next, the inner cylinder 22 is quietly inserted into the outer cylinder 21 to float in the oil. As the inner cylinder 22 sinks in the oil, air in the inner cylinder is forced to enter into the vent cylinder 26 and discharged outside through the printing sheet P. An observer watches a scale on the outer cylinder 21 and measures time (seconds) required for 100 ml of air to permeate through the specimen. The time (seconds) required for the air-permeation represents the air-permeability of the specimen.

The printing sheet P used in the present invention is general-purpose, having air-permeability ranging from 9 to 60 (seconds), preferably from 15 to 40 (seconds).

Further, viscosity ($\eta$) of the ink 2 ranges from 22 to 35 at 60-seconds value on a spread-meter for printing the printing sheet P having said air-permeability.

Further, suction force V by the suction duct 9 of the printing-suction section is preferably within a range of 0.15 to 0.3 kgf/cm$^2$ for forcing the ink 2 to transfer to the printing sheet P through the stencil sheet.

Those values are related to each other by the equation, $$V\ 1/\eta \cdot t.$$

Next, operation of the machine thus constituted will be explained.

A perforated stencil sheet is wound around the outer peripheral surface 1*b* of the rotary drum 1. When the rotary drum 1 is rotating, the sheet supply means 11 feeds a printing sheet P between the rotary drum 1 and the suction-conveying means 5.

The printing sheet P is conveyed while being held on the conveying belt 6*b* by suction of the suction pump 8 of the suction-conveying means 5.

Next, the printing sheet P is pressed against the rotary drum 1 when the suction conveying section 5 is lifted up by the non-illustrated drive unit. The pressing force is of such small magnitude that the printing sheet P can contact the outer peripheral surface 1*b* of the rotary drum 1, so that mechanical load and noise can be reduced.

In this situation, when the suction pump 10 of the suction conveying section 5 begins to operate, the ink 2 inside the rotary drum 1 is sucked by an atmospheric pressure toward the opening 9*a* of the suction duct 9, and then permeate through the perforations of the stencil sheet, thereby transferring to the printing sheet P. Namely, the suction duct 9 sucks the ink 2 inside the rotary drum 1 from the bottom side of the printing sheet P while holding the printing sheet P and the stencil sheet on the drum 1.

Now, the opening 9*a* of the suction duct 9 is smaller than a printing area of the stencil sheet, and successively forms printed images on the printing sheet P according to the perforated images of the stencil sheet with the conveyance of the printing sheet P and the rotation of the rotary drum 1. The printing sheet P thus printed is discharged in succession onto the discharge tray 12.

According to the foregoing constitution, the ink 2 is transferred onto the printing sheet P after passing through the perforations of the stencil sheet under the atmospheric pressure; therefore, the ink 2 can move only in a direction of sucking by the atmospheric pressure and thus may not spread to leak.

Figure 3:
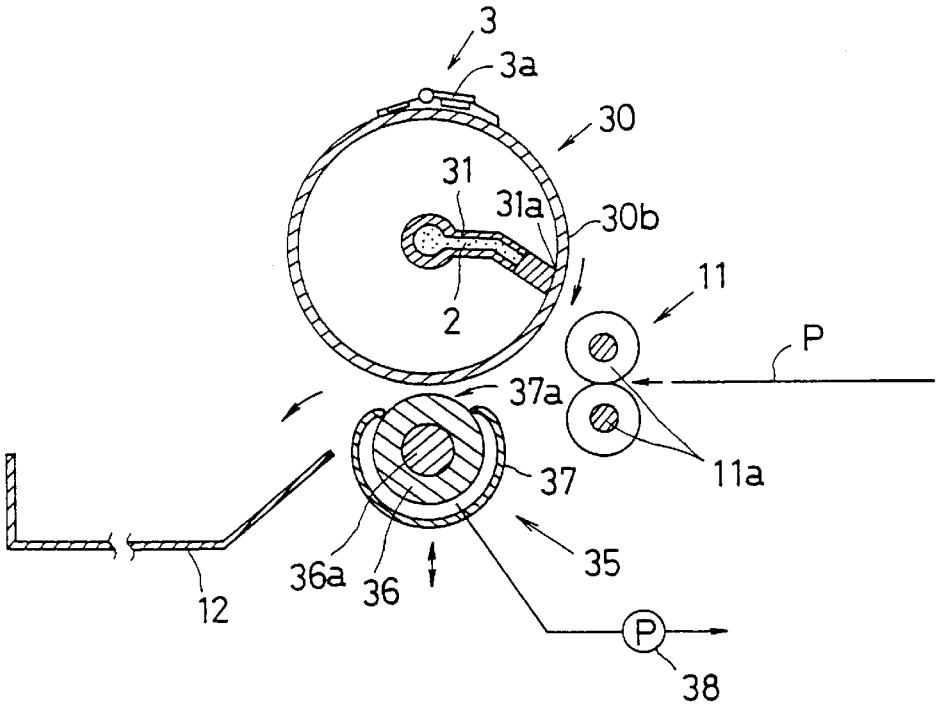
FIG. 3 is a sectional view of a stencil printing plate in a second embodiment of the present invention.

Next, FIG. 3 shows a stencil printing machine in a second embodiment of the present invention. The same parts are indicated by the same reference numerals, and description thereof is omitted.

A rotary drum 30 is cylindrical and driven to rotate around a central axis in a direction as indicated by an arrow in the drawing. On an outer peripheral surface of the rotary drum 30, there is formed a large number of fine holes.

Further, a squeegee 31 is fixedly disposed inside the rotary drum 30 in a upstream position relative to the rotating direction of the rotary drum 30 and corresponding to a position where a suction conveying means 35 is disposed as explained later. A passage is formed inside the squeegee 31 for applying the ink 2. Through an opened end portion 31*a* of the squeegee, the ink 2 is provided to the stencil sheet on the outer peripheral surface 30*b* through an inner peripheral surface of the rotary drum 30.

The stencil sheet with a perforated image formed therein is wound around the outer peripheral surface 30*b* of the rotary drum 30, and the leading end thereof is held by the clamp plate 3*a* of the clamping means 3.

The suction means 35 is disposed opposite to the rotary drum 30. The suction means 35 comprises a roller 36, a cylindrical enclosure 37, and a suction pump 38. The suction means 35 is so constituted that it sucks the ink 2 while assisting the printing sheet P to be conveyed. The roller 36 is all composed of porous material with air-permeability and driven to rotate around a rotating axis 36*a* by a non-illustrated drive motor.

The cylindrical enclosure 37 is such that it partially encloses the roller 36 airtightly and has an opening 37*a* formed opposite to the rotary drum 30, thereby exposing a part of the roller 36. The opening 37*a* is formed in a longitudinal shape, which corresponds to the axial-length of the rotary drum 30, along a direction perpendicular to the sheet-surface of the drawing.

A suction pump 38 sucks air inside of the cylindrical enclosure 37 at a predetermined suction force.

Further, the suction means 35 is movable upwardly end downwardly beneath the rotary drum 1 by a non-illustrated drive unit. The suction means 35 presses the printing sheet P against the rotary drum 30 by moving upward in synchronization with the conveyance of the printing sheet P, and avoids a collision with the clamping means 3 by moving downwards after the conveyance.

Next, operation of the machine thus constituted will be explained.

A perforated stencil sheet is wound around the outer peripheral surface 30*b* of the rotary drum 30. When the rotary drum 30 is rotating, the sheet supply means 11 feeds a printing sheet P between the rotary drum 30 and the suction-conveying means 35.

Next, when the suction means 35 is lifted up by the drive unit, the printing sheet P is pressed against the rotary drum 30 and conveyed by rotation of the roller 36. The pressing force is of such small magnitude that the printing sheet P can contact the stencil sheet on the outer peripheral surface 30*b* of the rotary drum 30.

During such operation, the ink 2 is applied to the outer peripheral surface 30*b* of the rotary drum 30 through the opened end portion 31*a*, and then reaches a position facing the roller 36 of the suction means 35 after a predetermined time or moving across a predetermined distance.

Then, the ink 2 inside the rotary drum 30 is sucked by the atmospheric pressure toward the opening 37*a*, and forced to permeate through the perforations of the stencil sheet, thereby transferring to the printing sheet P. Namely, the suction pump 38 sucks the ink 2 inside the rotary drum 1 from the bottom of the printing sheet P while holding the printing sheet P and the stencil sheet against the rotary drum.

Now, the opening 37*a* is smaller than a printing area of the stencil sheet, and successively forms printed images on the printing sheet P according to the perforated images of the stencil sheet with the conveyance of the printing sheet P and the rotation of the rotary drum 30.

The printing sheet P thus printed is discharged in succession onto the discharge tray 12.

In such a constitution where the ink 2 is thin applied to the stencil sheet and is sucked to transfer onto the printing sheet P by the suction means 35 after an interval, an excessive amount of ink is not applied to the printing sheet so that quality of images is assured and the set-off is reduced.

Figure 4:
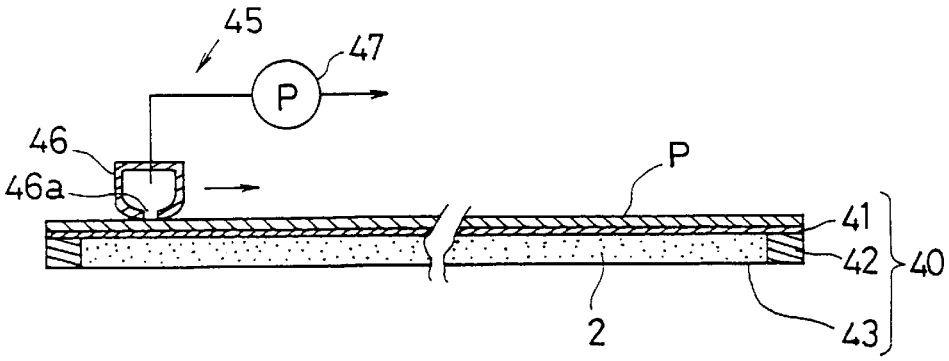
FIG. 4 is a sectional view of a stencil printing plate in a third embodiment of the present invention.

Next, FIG. 4 shows a stencil printing machine in a third embodiment of the present invention.

The embodiment is of such a type that a printing sheet P contacts a perforated stencil-sheet assembly in a flat manner while being printed by the assembly.

The stencil-sheet assembly 40 comprises a frame 42 with a predetermined thickness, a stencil sheet 41 attached to the periphery on one surface of the frame 42, and an ink-impermeable film 43 disposed on the other surface of the frame 42.

The stencil sheet 41 has a perforated image formed therein. Ink 2 fills a space between the stencil sheet 41 and the film 43, and is thus retained inside the frame 42.

The printing sheet P is placed in contact with the stencil sheet 41 of the stencil-sheet assembly 40 that is arranged on a base surface. The printing sheet and the stencil-sheet assembly are held in contact with each other.

A suction means 45 is disposed over the printing sheet P. The suction means 45 includes a suction nozzle 46 having an opening 46*a*, and a suction pump 47. The opening 46*a* is formed in a longitudinal shape, which corresponds to the width of the stencil-sheet assembly 40, along a direction perpendicular to the sheet-surface of the drawing.

Further, the suction nozzle 46 is movable in a direction of the length of the stencil-sheet assembly 40 by a non-illustrated drive means.

According to the constitution described above, the ink 2 in the stencil-sheet assembly 40 is sucked by the suction nozzle 46 at the opening 46*a* under the atmospheric pressure. The ink 2 passes through the perforated portion of the stencil sheet 41, and then transfers to the printing sheet P. That is, the suction nozzle 46 sucks the ink 2 inside the ink-impermeable film 43 from the upper surface of the printing sheet P through the printing sheet P and the stencil sheet.

Now, the opening 46*a* is smaller than a printing area of the stencil sheet, and successively forms printed images on the whole area of the printing sheet P according to the perforated images of the stencil sheet with movement of the suction nozzle 46.

The present constitution can also achieve the same operation and the same effect as those of the forgoing embodiments.

Figure 5:
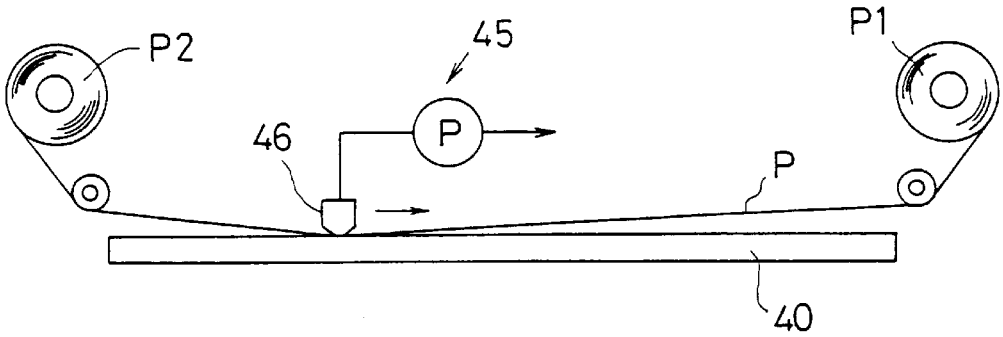
FIG. 5 is a sectional view of a stencil printing plate in a fourth embodiment of the present invention.

Next, FIG. 5 is a side elevation of a fourth embodiment in the present invention. The same parts in the drawing are indicated by the same reference numerals in the third embodiment, and description thereof is omitted. As illustrated in the drawing, the printing sheet P is a rolled sheet which is moved in a unrolled form of a predetermined length from a providing unit P1 toward a rolling unit P2.

In such a constitution, a printing image can be also formed on the printing sheet P by moving the suction nozzle 46 of the suction means 45 on the printing sheet P along the length-direction of the unrolled sheet.

Then, after the suction nozzle 46 moves one operational length in the length-direction of the unrolled sheet P to complete one printing operation, the providing unit P1 feeds the printing sheet P toward the rolling unit P2, thereby repeating the same printing operation.

Figure 6:
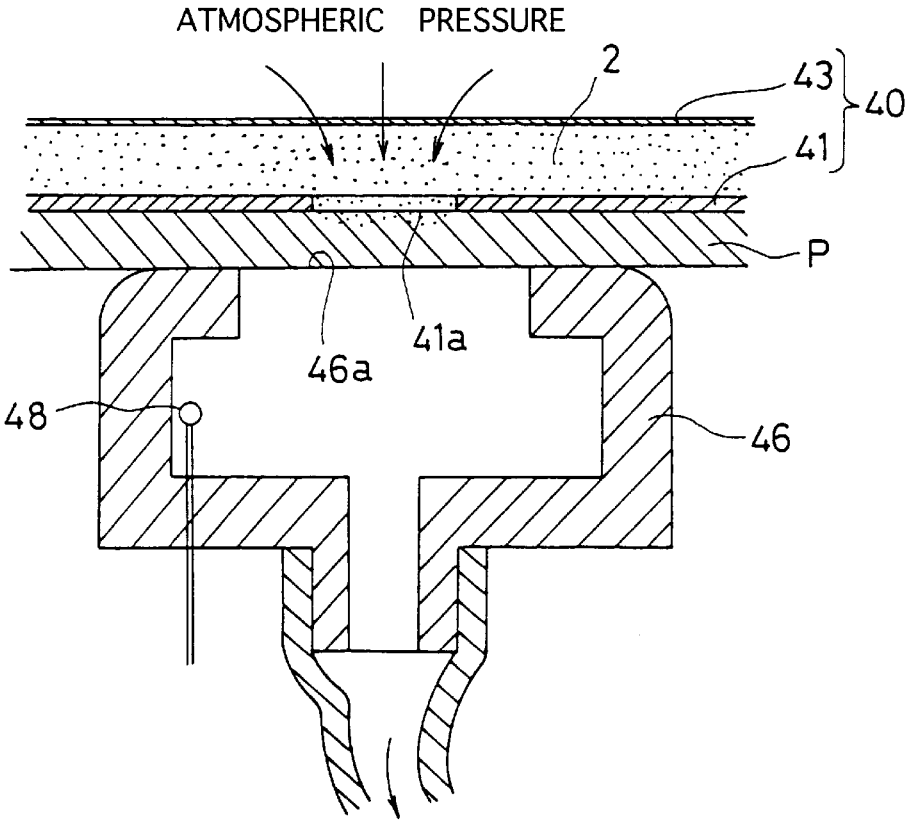
FIG. 6 is an enlarged fragmentary sectional view showing a suction means.

FIG. 6 is an enlarged fragmentary sectional view of the suction means described in the forgoing embodiments. Referring to the drawing, the suction printing in the present invention will be re-explained. The drawing illustrates the printing mechanism explained in the third embodiment (FIG. 4) in which the stencil sheet assembly 40 is used.

The suction nozzle 46 sucks the ink 2 stored in the stencil sheet assembly 40 through the printing sheet P, when the opening 46*a* is moved to be located under a perforation 41*a* formed in the stencil sheet 41.

The ink 2 is forced by the atmospheric pressure to permeate through the perforation 41*a*, and then adheres onto the printing sheet P. Since the ink on the stencil sheet moves only in the direction of suction by the atmospheric pressure, the ink 2 may not spread to leak. Further, the ink 2 is sucked to move only in the thickness direction of the printing material when it is transferred to the printing sheet P through the perforation 41*a*. Hence, ink bleeding by diffusion in the printing sheet P is reduced, and a clear printed image is obtained. Additionally, sucking helps the ink to permeate into the printing sheet P, thereby reducing the set-off.

A pressure sensor 48 is disposed in the suction nozzle 46. The pressure sensor 48 detects suction force and outputs a detecting signal to a non-illustrated control device. Data representing air-permeability (t) of the printing sheet P for use and viscosity (η) of the ink is entered into the control device and stored therein. The control device computes the suction force (V) from said equation on the basis of the data.

Then the control device controls the suction pump 47 while monitoring the detecting signal from the pressure sensor 48 so that the suction force of the suction pump 47 is held constant at a value as computed.

According to the equation, the suction force V is held lower when the air-permeability (t) of the printing sheet P is higher, and the suction force V is held higher when the air-permeability (t) of the printing sheet P is lower.

In the forgoing explanation of the suction printing mechanism, the third embodiment is cited as an example; however, control function of a control device in each embodiment is substantially the same since basic mechanism for sucking the ink 2 in each embodiment coincides with each other.

Figure 7:
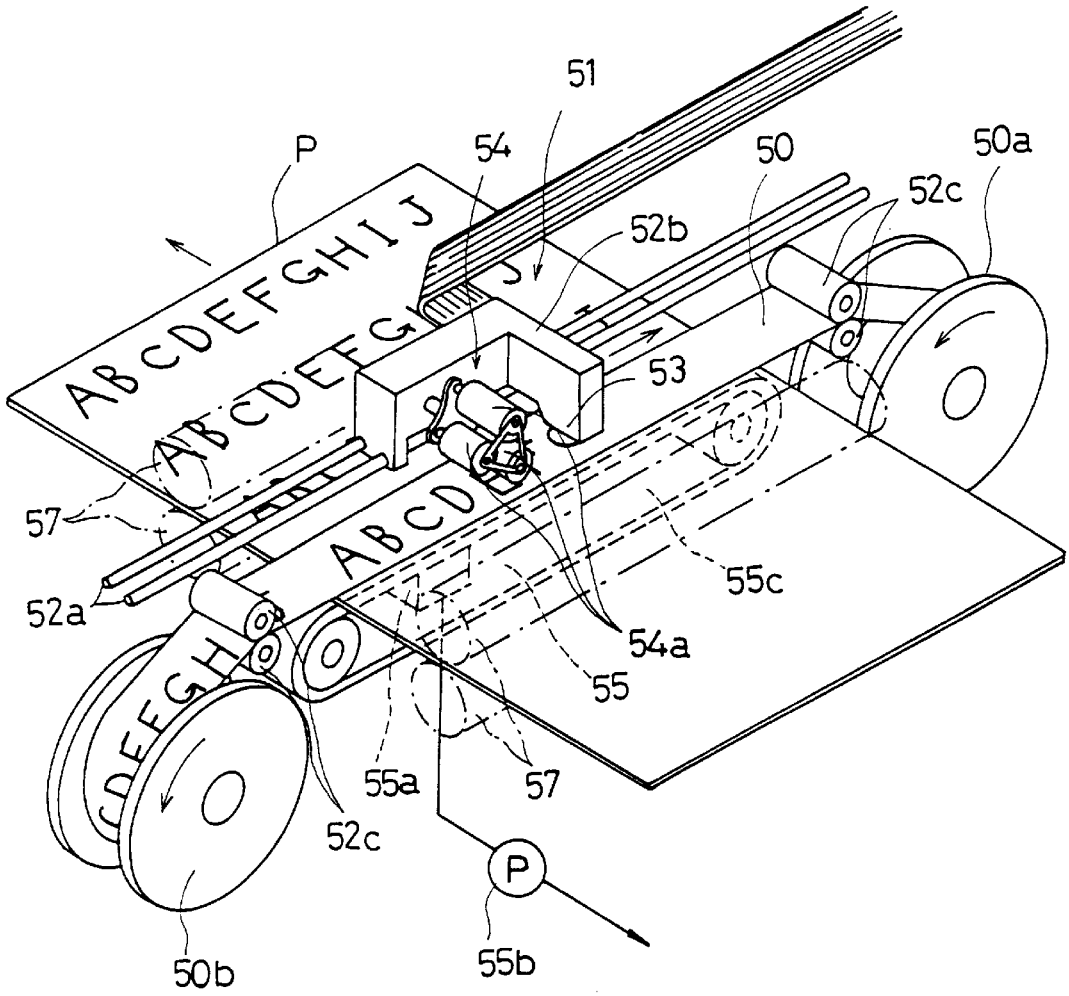
FIG. 7 is a sectional view of a stencil printing plate in a fifth embodiment of the present invention.

Next, FIG. 7 is a perspective view illustrating a fifth embodiment of the present invention.

In this embodiment, a stencil sheet 50 is in a form of a continuous strip. The stencil sheet is fed from a providing unit 50*a*. Next, at perforating and applying means 51, the stencil sheet is perforated and ink is applied thereon. And then the stencil sheet is sucked by suction means 55 for completing suction printing, and is wound around a rolling unit 50*b*.

The perforating and applying means 51 is disposed over one surface (top surface) of the printing sheet P. The suction means 55 is provided beneath the other surface (bottom surface) of the printing sheet P.

Further, the printing sheet P is conveyed by a conveying roller 57 in a longitudinal direction (sub-scanning direction) of the printing sheet.

The perforating and applying means 51 includes a carriage that is movable on a guide rail 52*a* disposed along a main scanning direction of the printing sheet P. The carriage 52*b* includes a thermal head 53 for thermally perforating the stencil sheet 50 and ink applying means 54. Further, tension rollers 52*c* are disposed to the stencil sheet 50 for applying tension thereto.

The ink applying means 54 includes three rollers 54*a* respectively containing ink of three different colors such as cyan, magenta, and yellow. One of the three rollers 54*a* contacts the stencil sheet 50 for applying ink thereon while printing.

The suction means 55 includes a suction nozzle 55*a* and a suction pump 55*b*. The suction nozzle 55*a* is attached to a scan belt 55*c* disposed along the main scanning direction of the printing sheet P, thereby being movable along the same direction.

Now, the suction means 55 is controlled by a non-illustrated control device to move along the main scanning direction in synchronization with movement in the same direction of the perforating and applying means 51; however, the perforating and applying means 51 always move ahead of the suction means 55 in the main scanning direction and the suction means 55 follows the perforating and applying means 51 at intervals of distance or time.

Operation in the forgoing constitution will be explained. Immediately after the thermal head 53 perforates the stencil sheet 50 while the carriage 52*b* of the perforating and applying means 51 moves over the printing sheet P in the main scanning direction, the ink apply means 54 applies ink of predetermined color to the stencil sheet 50.

The suction nozzle 55*a* of the suction means 55 moves in the same direction at a certain distance behind the rollers, and sucks the ink 2 applied on the stencil sheet 50 through the printing sheet P. The ink 2 is forced to pass through the perforations of the stencil sheet 50 by the atmospheric pressure, thereby transferring to the printing sheet P.

After scanning one line in the main scanning direction, the perforating and applying means 51 and the suction means 55 are restored to initial positions, and the stencil sheet 50 of a predetermined length is fed by the providing unit 50*a* for next perforation. And after the printing sheet P moves in the sub-scanning direction, perforating and printing along the main scanning direction is again conducted on the next line. This operation is repeated, thereby completing printing on the whole area of the printing sheet P.

Figure 8:
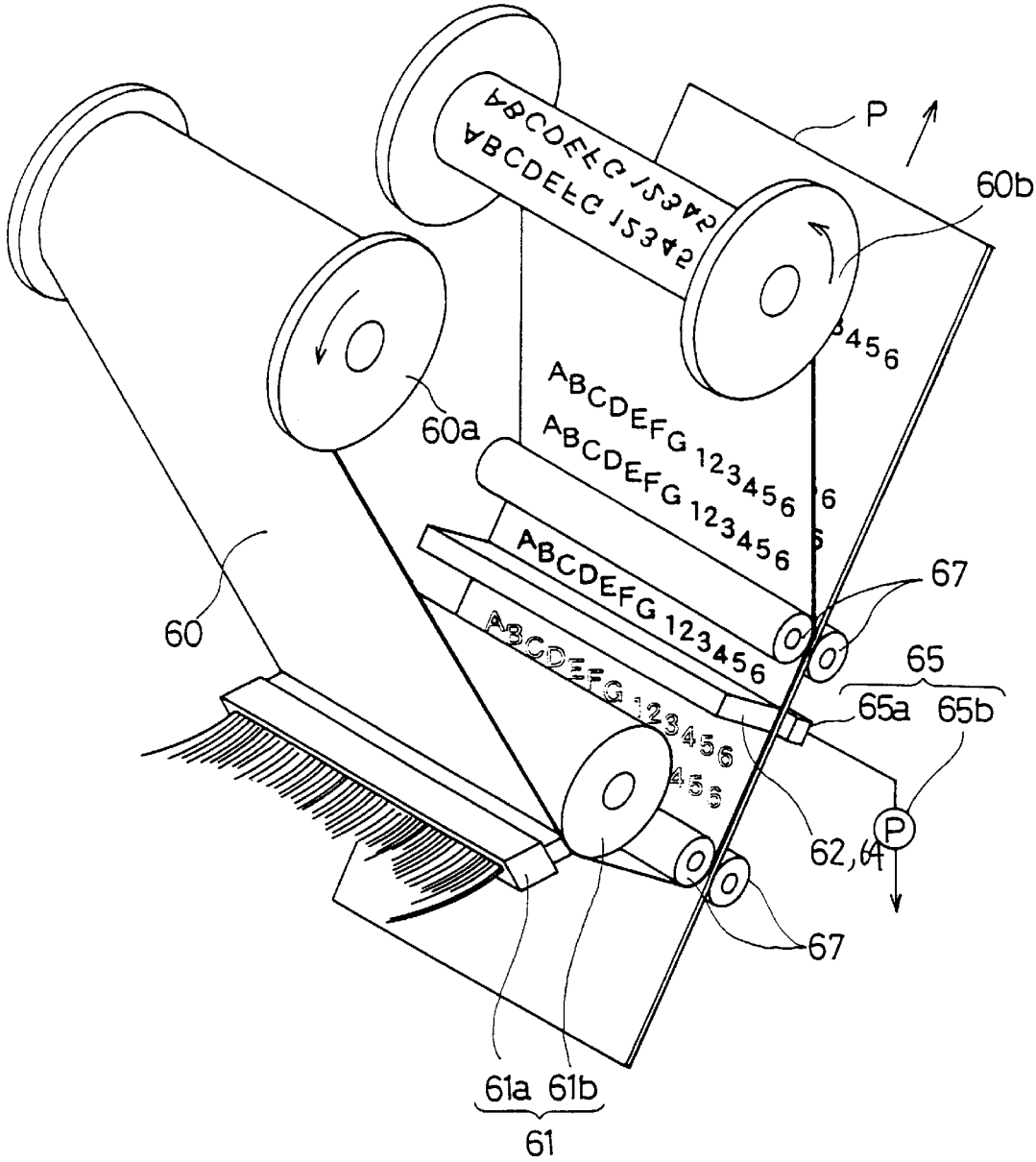
FIG. 8 is a sectional view of a stencil printing plate in a sixth embodiment of the present invention.

Next, FIG. 8 is a perspective view illustrating a sixth embodiment of the present invention.

In the present embodiment, which is a variant of the fourth embodiment, the width of a stencil sheet 60 corresponds with that of the printing sheet. The stencil sheet 60 is fed by a providing unit 60*a*. Next, after being perforated by perforating means 61, the stencil sheet 60 is coated with ink by ink applying means 62. And then the stencil sheet is sucked by suction means 65 for completing suction printing, and is wound around a rolling unit 60*b*. The perforating means 61 and the ink applying means 62 are disposed over one surface (top surface) of the printing sheet P. The suction means 65 is disposed beneath the other surface (bottom surface) of the printing sheet P.

The perforating means 61 includes a thermal head 61*a* in a longitudinal shape disposed along a width-direction (main scanning direction) of the printing sheet P and platen 61*b* arranged opposite to the thermal head 61*a*.

The ink applying means 62, including a mist nozzle 64 in a longitudinal shape disposed along the width-direction of the printing sheet P, sprays onto the stencil sheet 60 with mist of ink.

The suction means 65 includes a suction nozzle 65*a* and a suction pump 65*b*. The suction nozzle 65*a* is disposed along the width-direction of the printing sheet P. The suction nozzle 65*a* is disposed opposite to the mist nozzle 64 of the ink applying means 62.

The printing sheet P is conveyed in the same direction (indicated by an arrow in the drawing) as that of the stencil sheet 60 by conveying rollers 67 rotated in synchronization with feeding of the stencil sheet 60.

Operation in the forgoing constitution will be explained. After being sent out, the stencil sheet 60 is perforated by the thermal head 61*a* of the perforating means 61, and then sprayed with mist of ink.

The suction nozzle 65*a* disposed opposite to the mist nozzle 64 sucks the ink on the stencil sheet 60 through the printing sheet P. The ink is forced to pass through the perforations of the stencil sheet 60 by the atmospheric pressure, thereby transferring to the printing sheet P.

The stencil sheet 60 and the printing sheet P move in a direction indicated by an arrow in the drawing, and whole area of the printing sheet P is thus printed.

According to the present invention, since printing is conducted by sucking the ink on the stencil sheet with the suction means from the printing material, the ink is pressed only in a direction of suction caused by the atmospheric pressure, so that the ink on the stencil sheet may not spread to leak.

Further, microscopic observation shows that the ink is pressed only in the thickness direction of the printing material when it is transferred onto the printing material from the stencil sheet. Hence, ink bleeding by diffusion in the printing material is reduced, and a clear printed image is obtained.

Additionally, sucking helps the ink to permeate to the inside of the printing material, thereby reducing the set-off.

Further, in the method where a small adequate amount of ink is thinly pre-applied on the stencil sheet and the suction is conducted at the next step, image quality is assured and the setoff is reduced. This is because only the ink applied to the stencil sheet is transferred to the printing material and excess ink is not transferred thereto.

Further, it is enough for printing that the stencil sheet is just superimposed over the printing material and pressing is not required. Accordingly, the stencil printing machine of the present invention can be designed that mechanical strength thereof is fairly lower, so that simplification of the machine and reduction of production costs are easily achieved.

What is claimed is:

1. A stencil printing machine comprising:

a drum rotationally driven around a central axis thereof and having an ink-permeable cylindrical peripheral wall so that a stencil sheet with a perforated image formed therein is wrapped around the peripheral wall to allow an outer surface of the stencil sheet to contact a printing material, ink supply means situated inside the peripheral wall of the drum, conveying means situated under the drum with the stencil sheet thereon for conveying said printing material together with rotation of the drum, said conveyer means having an air permeable endless belt, a conveying-suction section situated under an upper portion of the belt for sucking air through the belt so that the printing material is conveyed by the belt while being held on the belt by a suction force, and a printing-suction section situated under a part of the upper portion of the belt and facing the drum for providing a suction force to a part of a bottom surface of the printing material to allow ink in the drum to pass through the perforated image and then transfer to an upper surface of the printing material.

2. A stencil printing machine as defined in claim 1, wherein said belt forms a space between the upper portion and a lower portion thereof, and said conveying-suction section includes a suction portion in the space to suck air in the space.

3. A stencil printing machine as defined in claim 2, wherein said printing-suction section includes an elongated suction duct disposed in the space.

4. A stencil printing machine as defined in claim 1, wherein said ink supply means is formed inside the drum and supply the ink along the peripheral wall.

* * * * *